US010792554B2

(12) United States Patent
Chiu

(10) Patent No.: US 10,792,554 B2
(45) **Date of Patent: *Oct. 6, 2020**

(54) MULTIFORM COMBINATION GAME APPARATUS

(71) Applicant: Yen-Po Chiu, Taipei (TW)

(72) Inventor: Yen-Po Chiu, Taipei (TW)

( * ) Notice: Subject to any disclaimer, the term of this patent is extended or adjusted under 35 U.S.C. 154(b) by 84 days.

This patent is subject to a terminal disclaimer.

(21) Appl. No.: 15/809,052

(22) Filed: Nov. 10, 2017

(65) Prior Publication Data

US 2019/0143197 A1 May 16, 2019

(51) Int. Cl.
*A63F 3/04* (2006.01)
*A63H 33/10* (2006.01)

(52) U.S. Cl.
CPC ..... *A63F 3/0457* (2013.01); *A63H 33/107* (2013.01)

(58) Field of Classification Search
CPC ..... A63F 3/00
USPC ..... 273/276
See application file for complete search history.

(56) References Cited

U.S. PATENT DOCUMENTS 3,408,079 A * 10/1968 Kirikos ..... A63B 57/10 403/353
3,438,312 A * 4/1969 Becker ..... E01C 13/045 404/19
3,735,988 A * 5/1973 Palmer ..... A63B 67/02 428/17
4,008,548 A * 2/1977 Leclerc ..... E01C 13/045 428/131
6,475,055 B1 * 11/2002 Javer ..... A63H 33/12 446/108
6,511,093 B2 * 1/2003 Buerkle ..... B60R 21/23138 280/729
7,261,299 B1 * 8/2007 Chiu ..... A63B 5/16 273/440
9,114,325 B1 * 8/2015 Sternhill ..... A63H 33/107

* cited by examiner

*Primary Examiner* — John E Simms, Jr.
*Assistant Examiner* — Dolores R Collins
(74) *Attorney, Agent, or Firm* — Pro-Techtor International Services; Ian Oglesby

(57) ABSTRACT

A multiform combination game apparatus disclosed by the present invention includes at least one base and at least one connecting plate. After a connecting rod provided on each of the four corner outer sides of the connecting plates is caused to pass through a respective connecting hole in the base, locking members are used to fixedly lock and firmly position the connecting plates. Therefore, combinatorial changes in combining the abovementioned members enable assembling a game apparatus of diverse variety.

4 Claims, 4 Drawing Sheets

MULTIFORM COMBINATION GAME APPARATUS

BACKGROUND OF THE INVENTION

(a) Field of the Invention

The present invention relates to a multiform combination game apparatus, and more particularly to a game apparatus that enables a plurality of configurations.

(b) Description of the Prior Art

It is known that there are many kinds and types of game apparatuses on the market, however, as the conventional game apparatuses are limited to one uninteresting design structure, the parts thereof being unable to be combined with one another to produce additional configurations. Therefore, the general public and the education industry have reflected deeply on how to choose a game apparatus which can stimulate fun creativity in children while exercising and satisfy an autonomous gaming behavior for children through interaction between the learning mode and the game mode, and is a worthy topic that truly requires research, development, and innovation.

SUMMARY OF THE INVENTION

The primary object of the present invention is to provide a multiform combination game apparatus that is formed by assembling bases, connecting plates, and connecting rods, thereby enabling assembling the abovementioned members in a multitude of combinatorial configurations to form the multiform combination game apparatus depending upon children's needs.

To enable a further understanding of said objectives and the technological methods of the invention herein, a brief description of the drawings is provided below followed by a detailed description of the preferred embodiments.

DETAILED DESCRIPTION OF THE PREFERRED EMBODIMENTS

Figure 1:
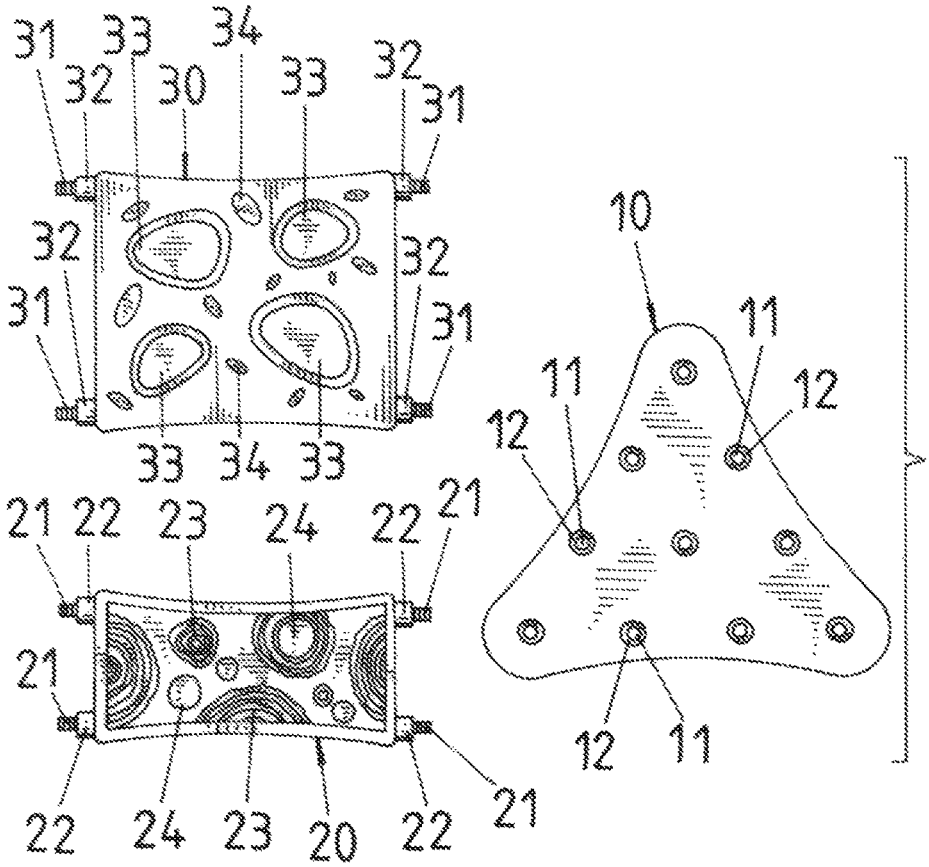
FIG. 1 shows a structural schematic view of the present invention.
Figure 2:
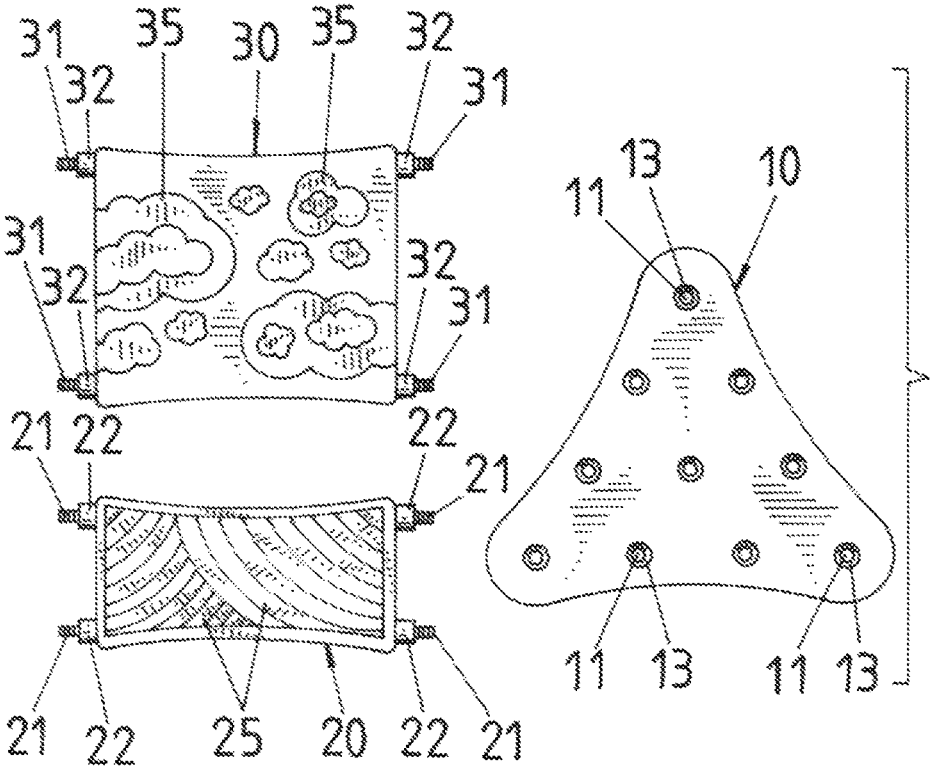
FIG. 2 shows a structural schematic view on the back surface of the present invention.
Figure 3:
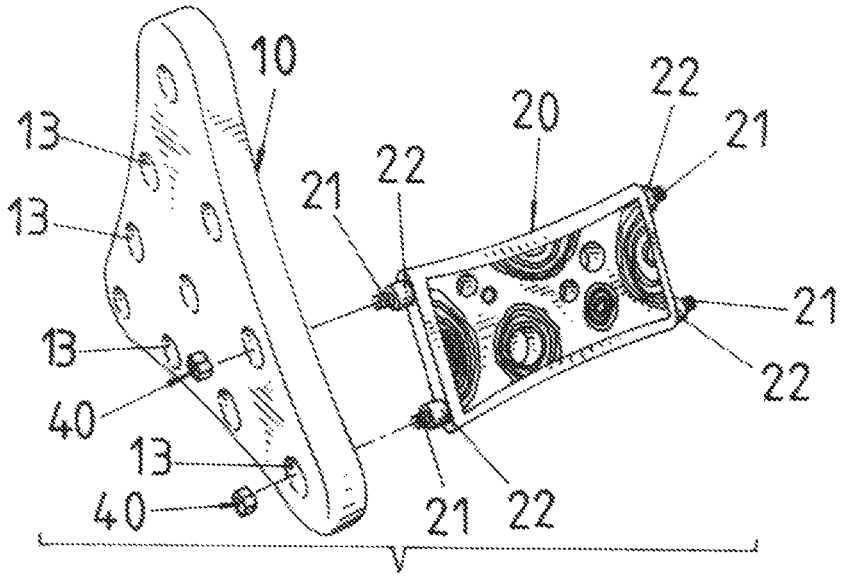
FIG. 3 shows a structural view illustrating a base and a connecting plate being locked together according to the present invention.
Figure 4:
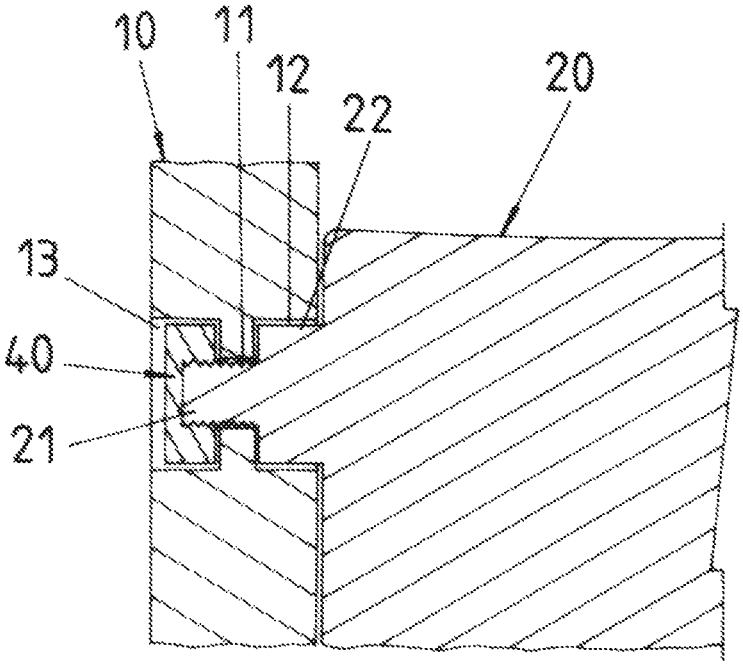
FIG. 4 shows a partial cross-sectional view of FIG. 3 of the present invention.

Referring to FIG. 1 to FIG. 3, which show a multiform combination game apparatus formed from an assembly of at least one base 10 and at least connecting plates 20, 30, wherein a preferred embodiment of the base 10 is a triangular shape. A plurality of connecting holes 11 are provided on each of the bases 10, and each triplet of the adjacent connecting holes 11 are arranged to form a triangle. The connecting plates 20, 30 have two different measurements. The connecting plate 20 is relatively narrow, while the other connecting plate 30 is relatively broader. Each of the four corner outer sides of the aforementioned connecting plates 20, 30 are each provided with a connecting rod 21, 31, respectively, and threaded teeth are provided on each of the connecting rods 21, 31. After respectively passing through the connecting holes 11 of the base 10, locking members 40 are used to fixedly lock and firmly position the connecting plates 20, 30. Referring to FIG. 4, which shows two ends of the connecting hole 11 of the base 10 provided with a recessed hole 12, 13, respectively, and the inner side of each of the connecting rods 21, 31 is provided with a protruding post 22, 32, respectively. When the connecting rods 21, 31 are caused to pass through the connecting holes 11 of the base 10, the protruding posts 22 are seated within the recessed holes 12 on one side of the connecting holes 11, whereupon the recessed holes 13 on the other side of the connecting holes 11 is able to contain the locking members 40. Hence, when the connecting plates 20, 30 are used to connect and fixedly lock the adjacent base 10, the locking members 40 will not protrude out the outer side of the base 10.

Referring to FIG. 1, various types of patterned anti-slip lines 23 and different sized depressions 24 are provided on the face of the relatively smaller sized connecting plate 20, and a plurality of large-sized depressions 33 and relatively small-sized protruding pieces 34 are provided on the face of the relatively larger sized connecting plate 30, wherein the large-sized depressions 33 enable children to apply force therein when scrambling on the apparatus. Referring further to FIG. 2, different styled lines 25 are provided on the back surface of the relatively smaller sized connecting plate 20, and a plurality of cloud-shaped lines 35 are provided on the back surface of the relatively larger sized connecting plate 30.

Figure 5:
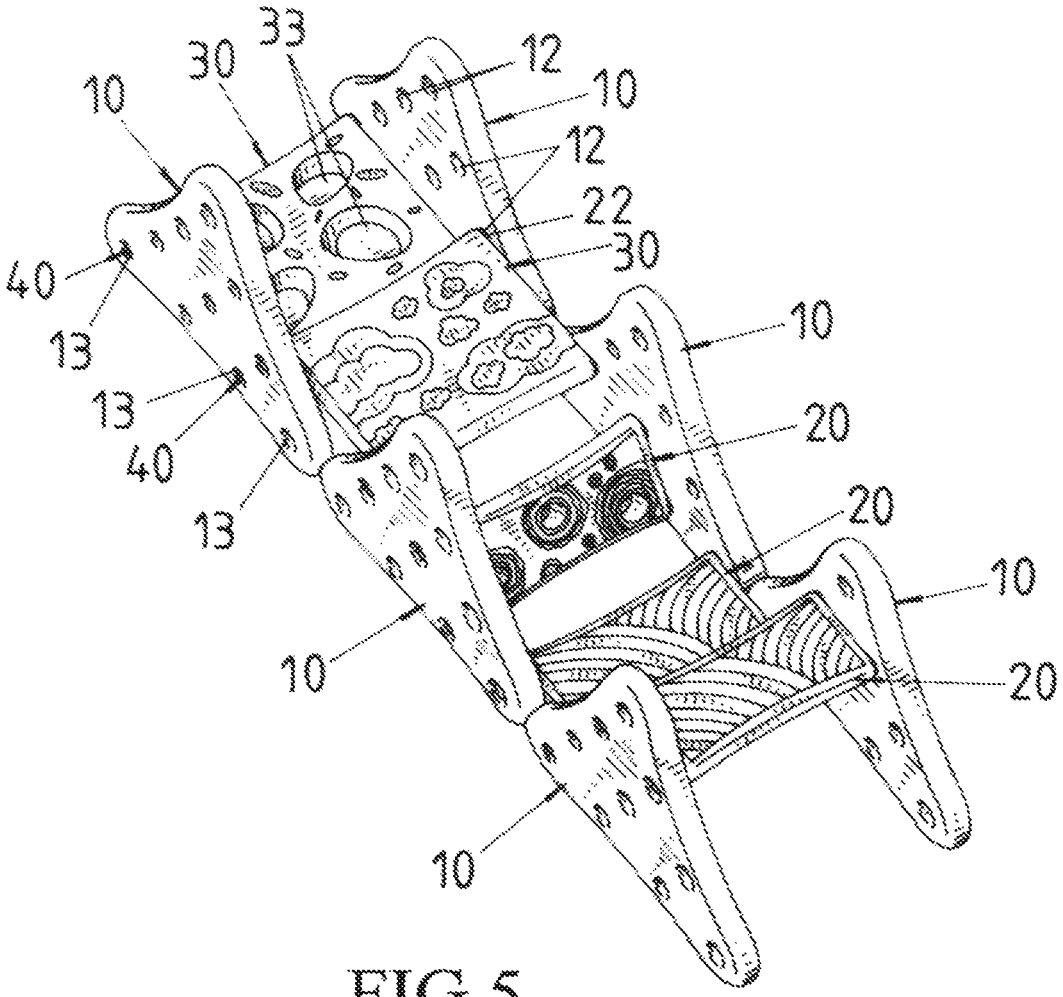
FIG. 5 shows a first structural schematic view of an assembled configuration of the present invention.
Figure 6:
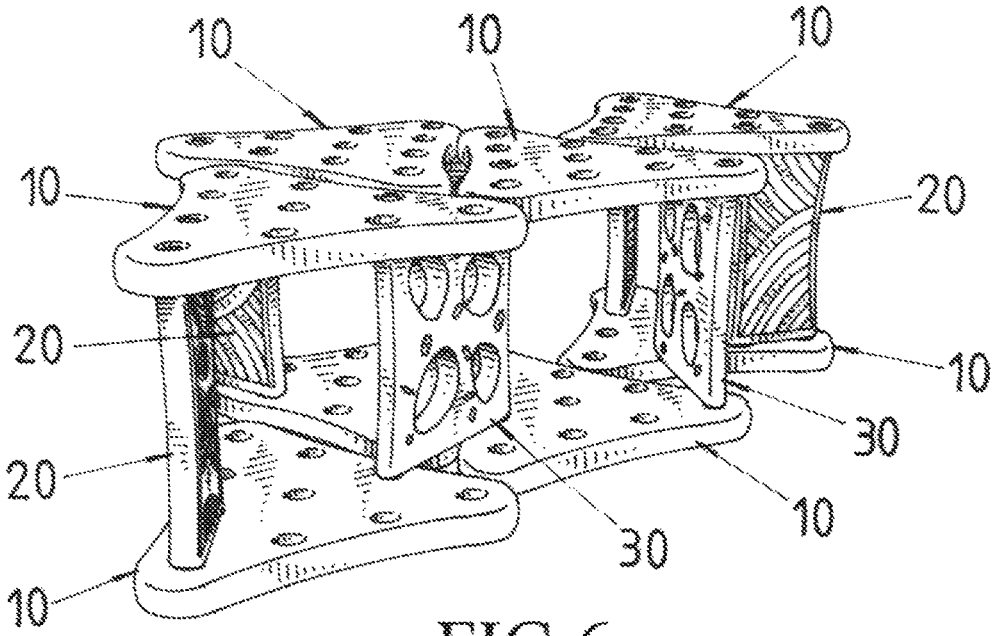
FIG. 6 shows a second structural schematic view of an assembled configuration of the present invention.
Figure 7:
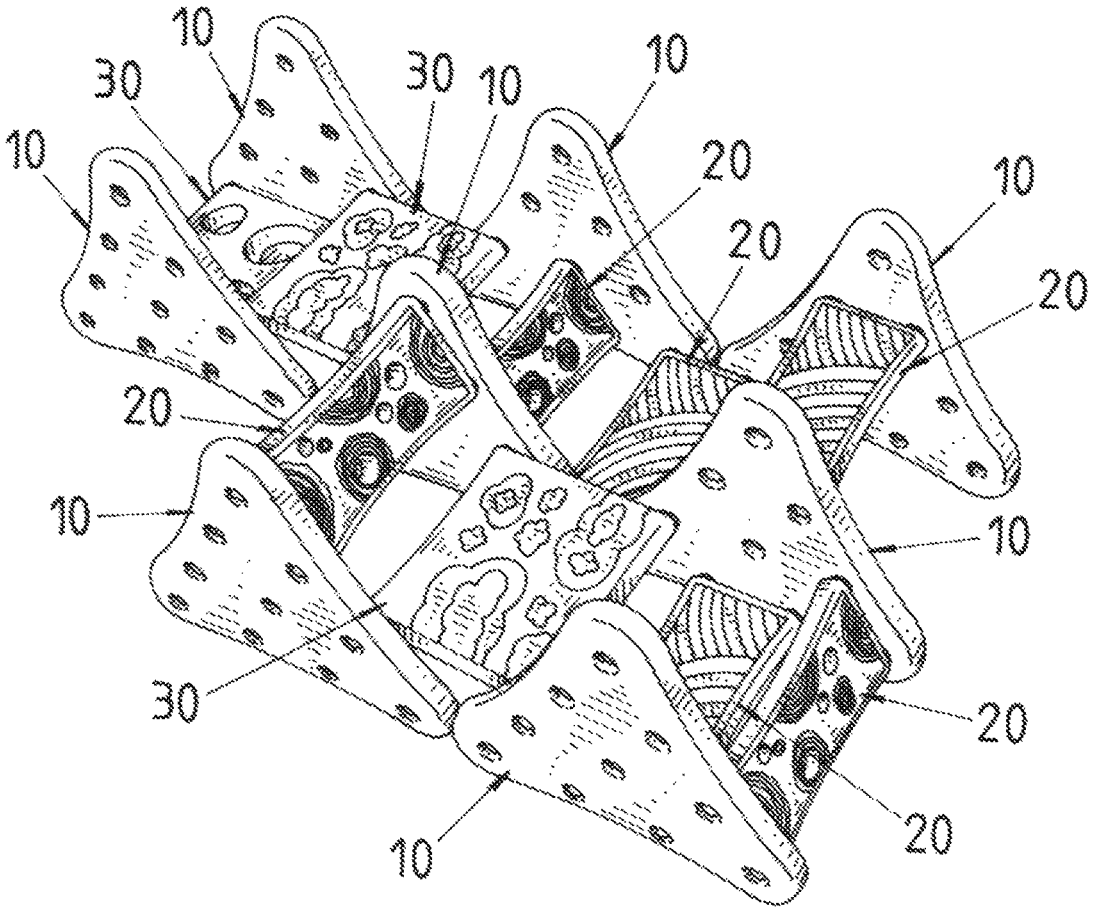
FIG. 7 shows a third structural schematic view of an assembled configuration of the present invention.

Accordingly, a staircase styled game apparatus can be assembled using a plurality of the triangular bases 10 and a plurality of the connecting plates 20, 30, as depicted in FIG. 5, or a burrow styled game apparatus can be assembled, as depicted in FIG. 6, or a treading and hopping styled game apparatus can be assembled, as depicted in FIG. 7. Hence, all kinds of game apparatuses can be formed by combining the abovementioned members.

In conclusion, and in accordance with the above description of the embodiments, the game apparatus of the present invention can provide enormous fun and can be played with in many different ways.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A multiform combination game apparatus, comprising:

at least one base, a plurality of connecting holes are provided on the base, and the two ends of each of the connecting holes are respectively provided with a recessed hole;

at least one connecting plate, each of the four corner outer sides of the connecting plate is respectively provided with a connecting rod, and the inner side of the connecting rod is provided with a protruding post; when the connecting rods are caused to pass through the connecting holes of the base, the protruding posts of the connecting rods are seated within the recessed holes on one side of the connecting holes, and the recessed hole on the other side of each of the connecting holes is used to contain a locking member.

2. The multiform combination game apparatus according to claim 1, wherein the base is a triangular shape.

3. The multiform combination game apparatus according to claim 1, wherein each triplet of the adjacent connecting holes are arranged to form a triangle.

4. The multiform combination game apparatus according to claim 1, wherein anti-slip lines, depressions, protruding pieces, and different styled lines are provided on the surfaces of the connecting plates.

* * * * *